US006257851B1

(12) United States Patent
Bush et al.

(10) Patent No.: US 6,257,851 B1
(45) Date of Patent: Jul. 10, 2001

(54) GENERALIZED MINIMUM DIAMETER SCROLL COMPONENT

(75) Inventors: James W. Bush, Skaneateles; Wayne P. Beagle, Chittenango, both of NY (US); Mark E. Housman, Plainville, MA (US)

(73) Assignee: Scroll Technologies, Arkadelphia, AR (US)

( * ) Notice: Subject to any disclaimer, the term of this patent is extended or adjusted under 35 U.S.C. 154(b) by 0 days.

(21) Appl. No.: 08/938,187

(22) Filed: Sep. 25, 1997

(51) Int. Cl.[7] ..... F01C 1/04
(52) U.S. Cl. ..... 418/55.2; 418/150
(58) Field of Search ..... 418/1, 55.2, 150

(56) References Cited

U.S. PATENT DOCUMENTS

| | | | |
|---|---|---|---|
| 3,874,827 | 4/1975 | Young | 418/55.2 |
| 4,303,379 | 12/1981 | Higara et al. | 418/55.2 |
| 4,304,535 | 12/1981 | Terauchi | 418/55.2 |
| 4,417,863 | 11/1983 | Ikegawa et al. | 418/55.2 |
| 4,477,239 | 10/1984 | Yoshii et al. | 418/55.2 |
| 4,490,099 | 12/1984 | Terauchi et al. | 418/55.2 |
| 4,494,914 | 1/1985 | Shiibayashi | 418/55.2 |
| 5,037,279 | 8/1991 | Suefuji et al. | 418/55.2 |
| 5,318,424 | 6/1994 | Bush et al. | 418/55.2 |
| 5,425,626 * | 6/1995 | Tojo et al. | 418/55.2 |

FOREIGN PATENT DOCUMENTS

| | | | |
|---|---|---|---|
| 0318189 | 5/1989 | (EP) . | |
| 59-105986 | 6/1984 | (JP) . | |
| 62-87601 * | 4/1987 | (JP) | 418/55.2 |
| 1-257783 | 10/1989 | (JP) . | |
| 2-110287 | 9/1990 | (JP) . | |
| 3-134285 | 6/1991 | (JP) . | |

* cited by examiner

*Primary Examiner*—John J. Vrablik
(74) *Attorney, Agent, or Firm*—Carlson, Gaskey & Olds

(57) ABSTRACT

A generalized technique is provided for maximizing the volumetric displacement of a gas within a scroll compressor having a scroll set including a fixed scroll wrap and an orbiting scroll wrap. The scroll wraps are designed to minimize the generating radius $R_g$ for at least the outer portion of the wrap and achieve a high generating radius for at least the inner portion of the wrap. The generating radius can be either evaluated as the absolute value or the mean value taken as an integration from the outer extremity of the wrap inward.

11 Claims, 5 Drawing Sheets

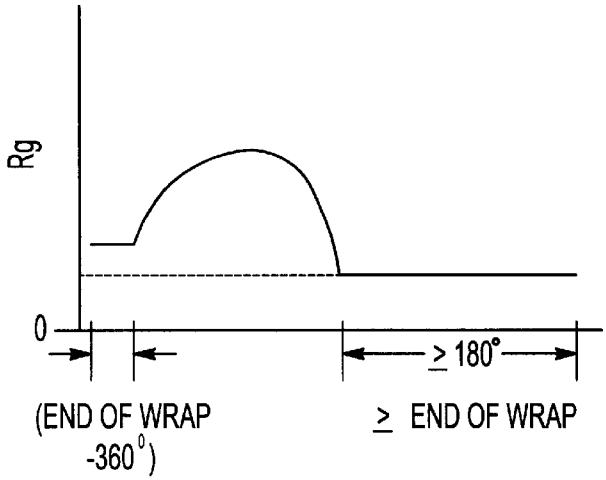
Fig-13
Fig-14
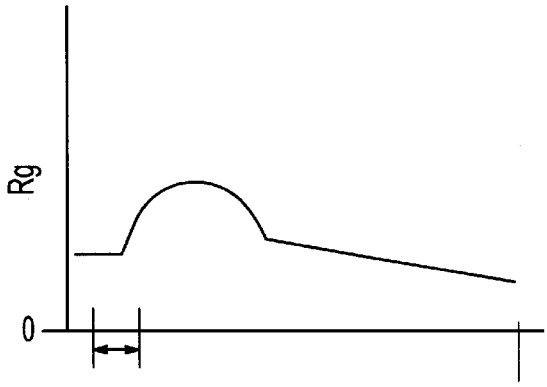
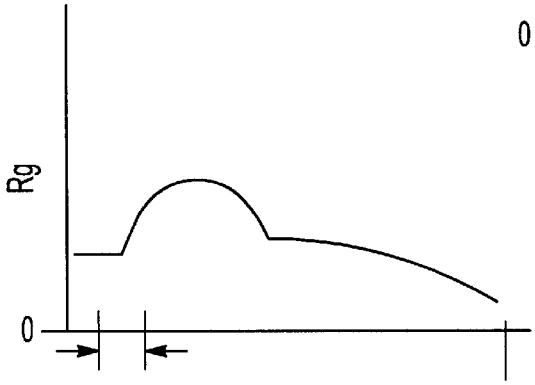
Fig-15
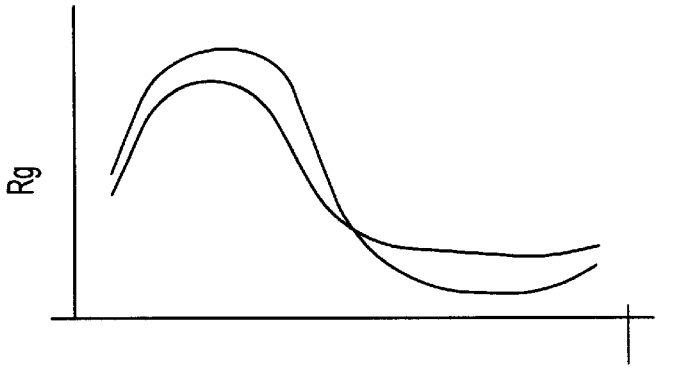
Fig-16

GENERALIZED MINIMUM DIAMETER SCROLL COMPONENT

BACKGROUND OF THE INVENTION

Conventional scroll compressors are designed around involutes of circles. Such designs are inherently eccentric in shape and present disadvantages in minimizing the size of the compressor since an enclosed diameter which is drawn on center with the wrap will necessarily include some unused space in the outer periphery. U.S. Pat. No. 5,318,424, issued on Jun. 7, 1994, addresses a design for scroll components that presents an outer wrap geometry that increases the displacement of a scroll compressor over that of a conventional involute of a circle. The specific method taught in that patent uses the combination of an arc of a circle at the outer most periphery which is blended through a high order curve to an involute of a circle scroll form in the inner wraps. While this design has been found to be effective, additional scroll designs intended to minimize the external dimensions of the scroll components while maximizing the compressed volume thereof are desirable.

SUMMARY OF THE INVENTION

A scroll element is provided for use in a scroll machine wherein the scroll element has a wrap surface extending from an outer point to an inner point and includes a low value for the generating radius for at least the outer portion of the wrap surface and a high value for the generating radius for at least the inner portion of the wrap surface without using, in sequence, from the outer portion to the inner portion, a segment of a circle, a high order curve and an involute.

In accordance with another aspect of the present invention, the low generating radius value can be an absolute or a mean value and the high value of generating radius can be either an absolute or mean value. It is an object of this invention to define the general requirements needed to increase scroll compressor displacement over that of conventional or offset wraps without introducing some of the attendant difficulties of these designs.

In accordance with another aspect of the present invention, the first pocket of a dual pocket scroll machine is designed with a wrap surface extending from an outer point to an inner point and includes a low value for the generating radius for at least the outer portion of the wrap surface and a high value for the generating radius for at least the inner portion of the wrap surface. In accordance with another aspect, both pockets of the dual pocket scroll machine are formed this way.

BRIEF DESCRIPTION OF THE DRAWINGS

For a fuller understanding of the present invention, reference should now be made to the following detailed description thereof taken in conjunction with the accompanying drawings wherein:

FIG. 13 shows a first embodiment of the present invention.

FIG. 14 shows a second embodiment of the present invention.

FIG. 15 shows a third embodiment of the present invention.

FIG. 16 shows a fourth embodiment of the present invention.

DESCRIPTION OF THE PREFERRED EMBODIMENT

U.S. Pat. No. 5,318,424, issued Jun. 7, 1994, which disclosure is hereby incorporated by reference herein, presents an outer wrap geometry which increases the displacement of a scroll compressor over that of a conventional involute of a circle. The specific design disclosed in U.S. Pat. No. 5,318,424 uses a combination of an arc of a circle at the outermost periphery which blends through a high order curve to an involute of a circle scroll form in the inner wrap. This is an effective configuration. However, it is a special case of an entire class of scroll wrap configurations which provide substantial benefit over configurations in prior use. It is possible to describe the characteristics of this class of scroll wraps in mathematical terms and to show how, for example, the well known offset involute of a circle fits within this class of curves. While the offset involute is found to occupy a certain range within this class, more effective scroll forms lie outside this range. Even more complex forms which lie within this range may provide up to and including the displacement advantage of offset wraps but without some of the disadvantages of operating loads which accompany the offset wrap.

Figure 1:
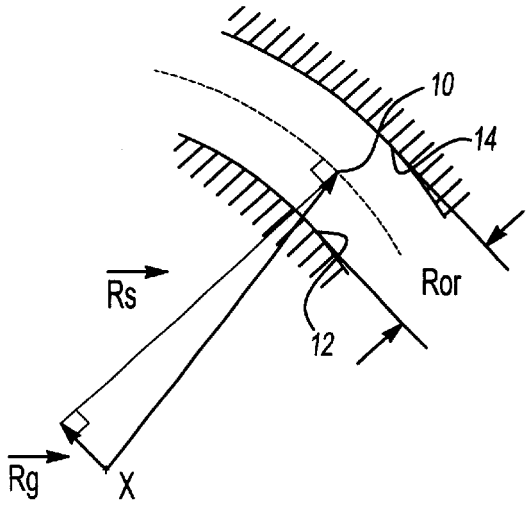
Fig-1 PRIOR ART
FIG. 1 is an illustrative view of the generating vectors for a scroll component.
Figure 12:
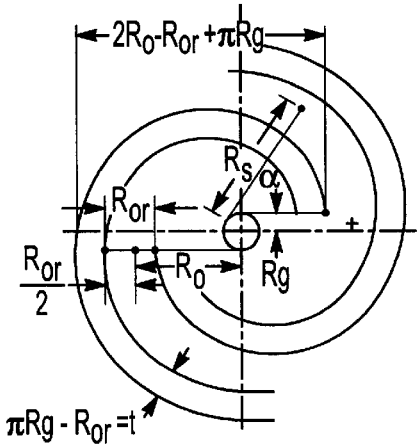
Fig-12 PRIOR ART
FIG. 12 is a graph of the scroll geometry nomenclature.

In the mathematical formulation of scroll wraps, all conjugate surfaces can be defined about a geometric center by two locating vectors. With reference to FIG. 1, the surface can be defined by a given conjugate point pair starting from the center X. The first vector is $R_g$, the generating radius, which is in a direction parallel to a tangent 10 to the conjugate surfaces 12 and 14 at the point pair. The second vector, $R_s$, is the swing radius, which is normal to the conjugate surfaces 12 and 14 at tangent 10. The magnitude, or length of $R_g$ determines the pitch of the spiral, or the rate or steepness with which it spirals inward or outward. The relationship between $R_g$ and $R_s$, given by the equation $$\frac{dR_s}{d\theta} = R_g$$

where θ is the wrap angle of the surfaces, guarantees conjugacy of the two surfaces. Reference to FIG. 12 illustrates the conventional presentation of vectors and variables.

Figure 2:
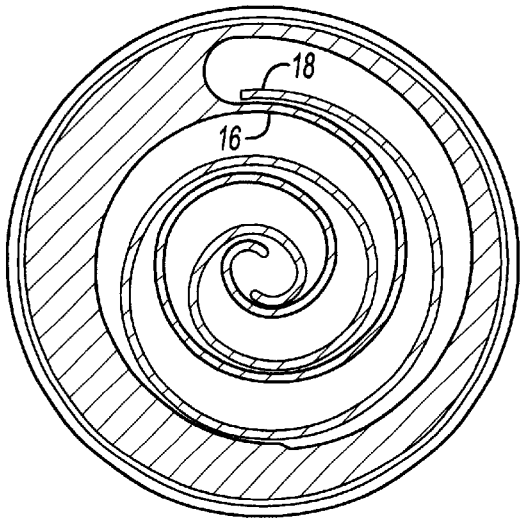
Fig-2 PRIOR ART
FIG. 2 is a sectional view showing first and second scroll elements formed with conventional circular involute curves.
Figure 3:
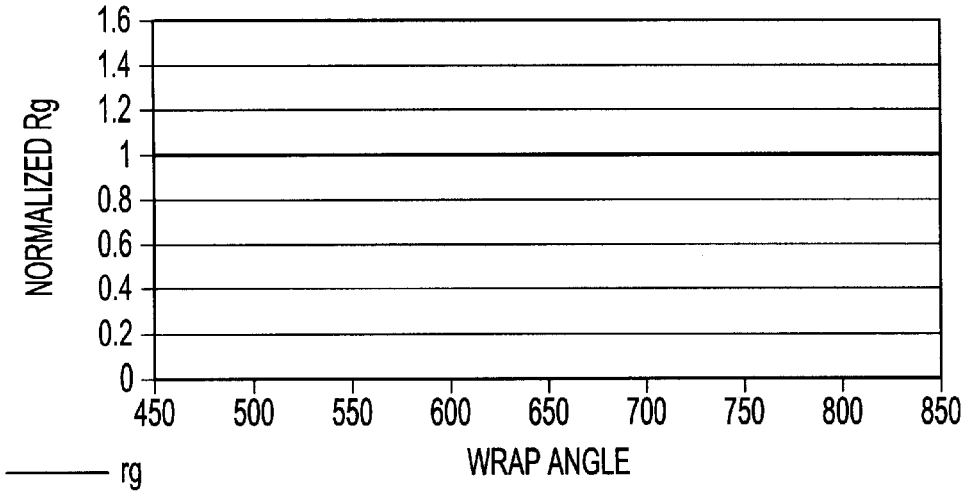
Fig-3 PRIOR ART
FIG. 3 is a graph of the generating radius for the circular involute scroll.

For a conventional involute of a circle, $R_g$ is a constant value, as seen in FIGS. 2 and 3, and the involute spiral is always moving in or out the same distance for a given angle along the spiral. The circular involute results in a scroll compressor as illustrated in FIG. 2, which has a fixed scroll wrap 16 and an orbiting scroll wrap 18. With reference to FIG. 3, the largest angle represents the outermost portion of the scroll wrap at the right hand side of the graph. As we follow the scroll inwardly, the angle θ decreases and moves to the left in the graph. At the final, innermost portion of the scroll wrap, the angle is 0 degrees. For the entire range of angles, the generating radius $R_g$ is constant as seen in FIG. 3 as a normalized dimensionless radius.

Figure 4:
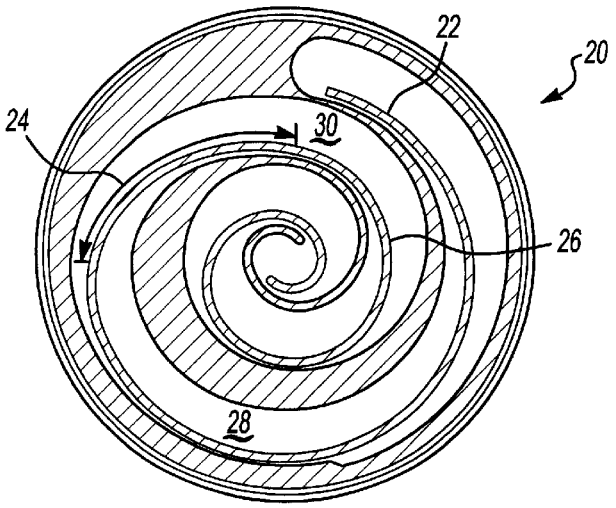
Fig-4 PRIOR ART
FIG. 4 is a sectional view of the first and second scroll elements with a hybrid wrap scroll as shown in U.S. Pat. No. 5,318,424.

U.S. Pat. No. 5,318,424 teaches a specific hybrid involute form which can have a variable $R_g$. The term "hybrid" is used to identify a scroll form made up of two or more separate curves which have been joined together. For these scrolls, the steepness or rate of change of the radius of the spiral with respect to a given wrap angle will vary. Advantage is taken of this feature to first, prevent the first wrap from moving inward as much as possible to maximize the displacement volume, then starting at the most inward point possible, pulling the wrap in very rapidly to prevent interference with the outer beginning of the wrap. FIG. 4 is a view of a hybrid wrap scroll set 20 designed according to the teachings of U.S. Pat. No. 5,318,424. The scroll set 20 has a first segment 22 being a segment of a circle, a second segment being a high order curve 24 and a third, and innermost segment, a conventional involute 26.

Figure 5:
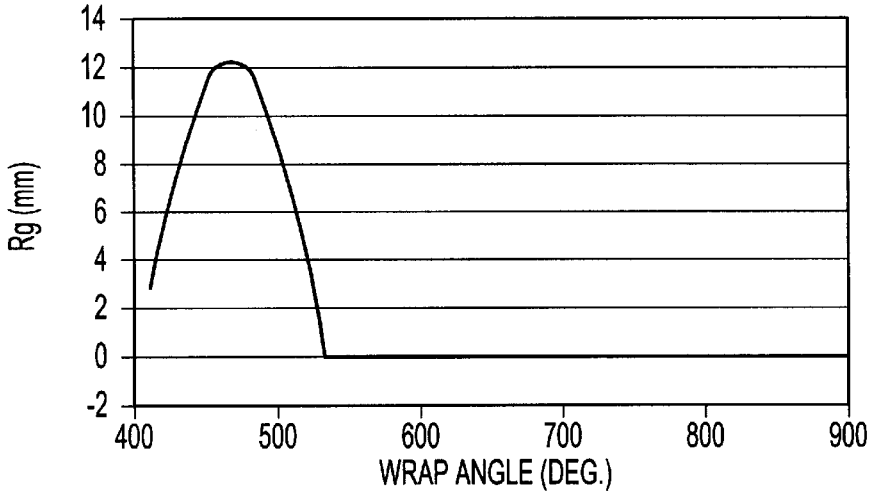
Fig-5 PRIOR ART
FIG. 5 is a graph of the generating radius for a first pocket of the scroll components in FIG. 4.

FIG. 5 is a graph of the generating radius for the first suction pocket 28 of scroll set 20 between the wrap angles of about 415 and 775+ degrees (for this example). Note that the generating radius is zero for the outer circular segment 22 of the pocket. Then, as the suction pocket is rapidly drawn inward to complete the first wrap, the generating radius rises to a very high value in the high order curve 24 corresponding to the momentarily steep pitch. The generating radius then subsides to match the value of the constant pitch involute inner segment 26 for the innermost wrap sections shown in FIG. 5.

Figure 6:
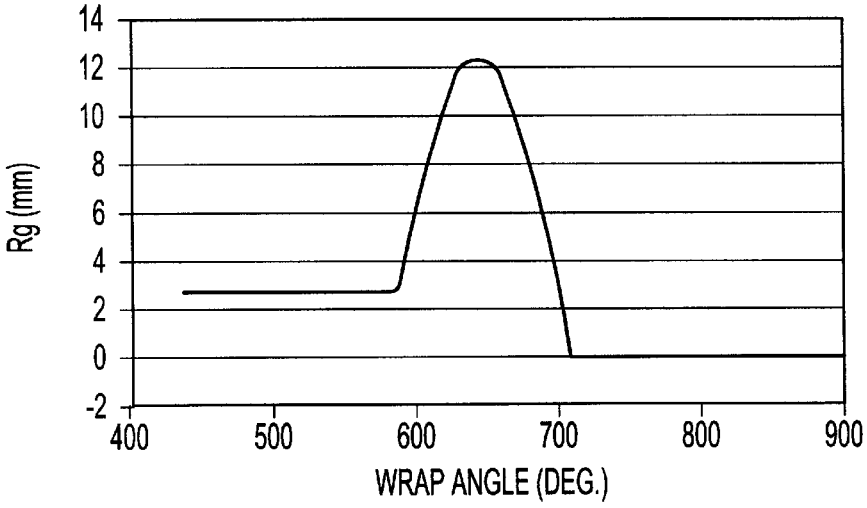
Fig-6 PRIOR ART
FIG. 6 is a graph of the generating radius for a second of the pockets of the scroll components in FIG. 4.

FIG. 6 shows the generating radius $R_g$ for the other suction pocket 30 of the hybrid wrap scroll set 20 between the wrap angles of about 440 and 800 degrees (for this example). Since this pocket 30 must nest with the first pocket 28, less of the outer portion of the wrap is held at the zero value of generating radius and more of the inner portion is at the constant value for the involute curve. Even so, this pocket still has the same characteristic lower outer value of generating radius, a momentary intermediate peak value, and an ending moderate value.

While this is an effective design, the ending moderate value is required only for integration of the outer wrap with the rest of the scroll form. A more radically designed overall form could conceivably dispense with the inner moderate value for the outer wrap. The essence of this design is the low outer value and a higher inner value, either on an absolute basis or on an average basis where the average is calculated by integrating the generating radius from the outer end of the scroll wrap toward the inner end.

In general, the effectiveness of a scroll suction pocket at maximizing displacement may be characterized by this behavior of the generating radius $R_g$. Pockets which have low values of generating radius $R_g$ at their outer region and higher values at their inner regions, like the hybrid wrap of FIGS. 4–6, have been generally moved radially outward and have correspondingly more displacement. Any scroll wrap which might have higher values of $R_g$ in the outer portion and a lower value in the inner portion has been pulled in radially and might be expected to have less displacement than even a conventional involute of a circle.

This method can be used to evaluate other scroll forms and their effectiveness at providing displacement volume. Two likely candidates are offset circular involute wraps, which have been used in the past to increase suction volume, and circular arc wraps, a seldom used but well known scroll form which, like the hybrid scroll of U.S. Pat. No. 5,318,424, uses circular arcs in the outer portion of the suction pocket but which also uses them throughout the entire scroll form.

The offset circular involute, though not using the sequence of curves of the hybrid wrap 20, still achieves some of the increased displacement. The circular arc wrap begins with an arc of a circle, much like the hybrid wrap and is spliced to other curves which are also arcs of circles, but of varying radius. However, analysis of the generating radius characteristic for these variations show a fundamental difference between these classes of curves and that used in the hybrid wrap of U.S. Pat. No. 5,318,424 and of this invention. The circular arc scroll is also a hybrid wrap, being composed of several different curves spliced together.

Figure 7:
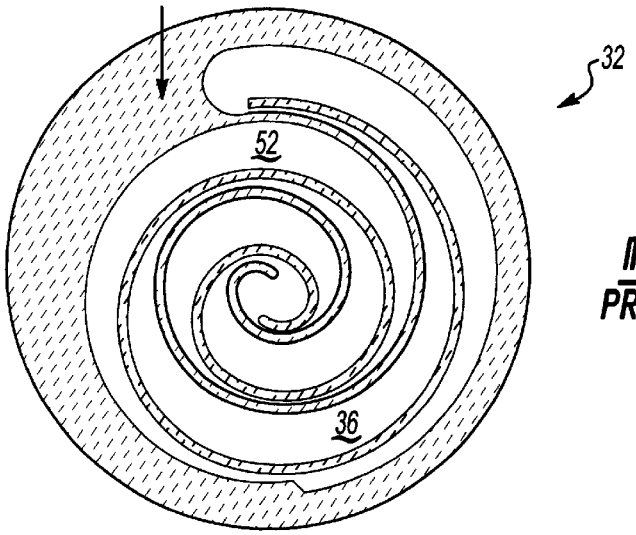
Fig-7 PRIOR ART
FIG. 7 is a sectional view of first and second scroll elements with an offset circular involute scroll.
Figure 8:
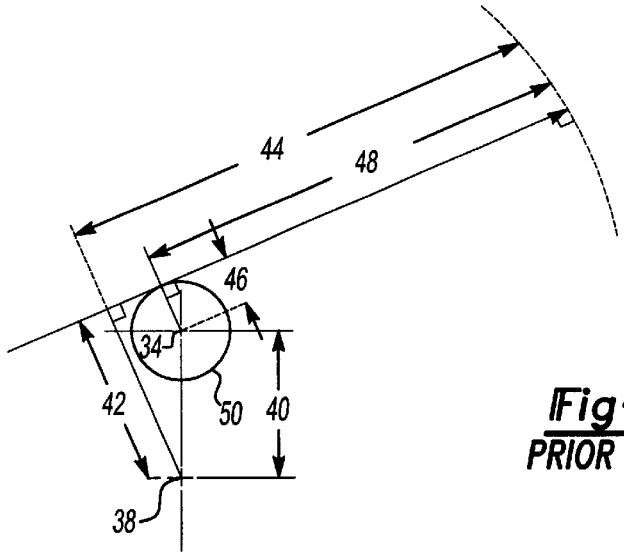
Fig-8 PRIOR ART
FIG. 8 is an illustration of the generating vectors for offset circular involute scrolls.

FIG. 7 is a view of an offset circular involute scroll set 32. The offset circular scroll set 32 has geometry virtually identical to the on-center involute scroll of FIG. 2, but has a center moved off the original geometric center 34, as seen in FIG. 8 to a new, offset, geometric center 38. The first outer suction pocket 36 in set 32 appears to be similar to that of the hybrid scroll set 20 since it occupies more of the outer periphery than the corresponding outer pocket of the on-center involute scroll of FIG. 2. It would thus seem that the increase in available displacement has been achieved without really changing the generating radius $R_g$. This is, however, not the case.

To evaluate effective displacement of a scroll set 32 within a given space, the scroll geometry must be evaluated relative to the center of that space 38, not relative to some arbitrary scroll geometric center 34. New values of the generating radius and swing radius can be derived relative to any arbitrarily translated center. As seen in FIG. 8, an offset 40 between the original geometric center 34 and the new geometric center 38 can be accounted for by defining the generating radius 42 with offset and the swing radius 44 with offset, as opposed to the original generating radius 46 and the original swing radius 48. The generating circle 50 of the original generating radius 46 is simply transformed from being centered on the original geometric center 34 to being offset from the new geometric center 38.

Figure 9:
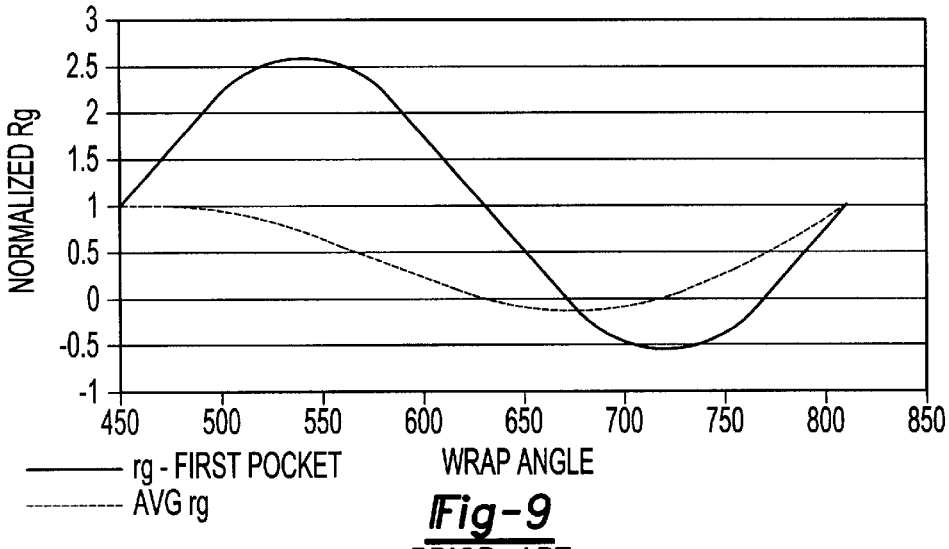
Fig-9 PRIOR ART
FIG. 9 is a graph of the generating radius for the first pocket of an offset circular involute scroll.

FIG. 9 illustrates the offset circular involute generating radius for the first pocket 36. The graph is normalized to the generating radius of the conventional involute scroll set which is given an arbitrary value of 1. Because the new geometric center 38 is a constant distance from the original geometric center 34, the generating radius relative to the new center 38 varies in a sinusoidal manner because of the offset. Also plotted on FIG. 9 is the average value of the generating radius relative to outer extent of the wrap. Like the hybrid wrap 20, both the instantaneous and the average values of generating radius are low at the beginning of the wrap, near the outside, and are higher at the inner portion of the wrap. While local variations of the generating radius mean that the offset wrap will not achieve as much increase in displacement as the hybrid wrap 20, it will do substantially better than the conventional on-center involute of a circle.

Figure 10:
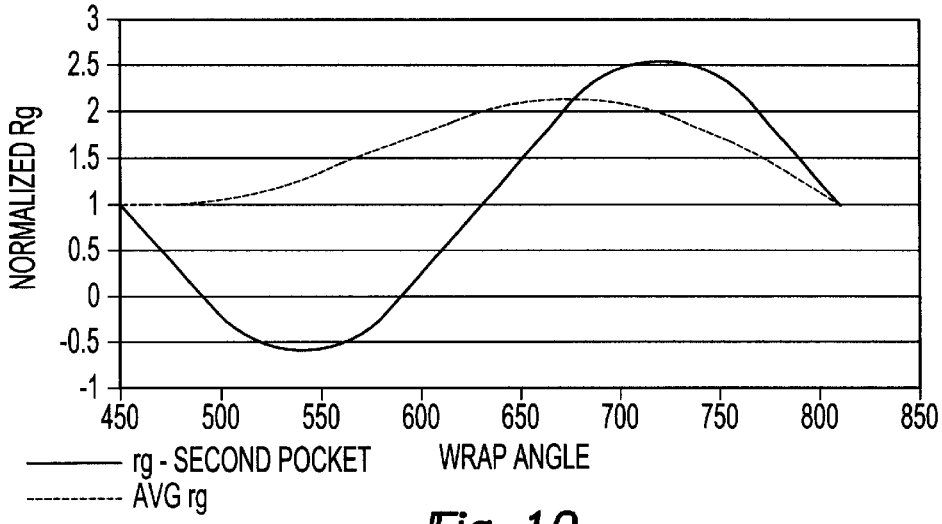
Fig-10 PRIOR ART
FIG. 10 is a graph of the generating radius for the second pocket of an offset circular involute scroll.

However, with reference to FIG. 10, the second pocket 52, referenced to the new geometric center 38, is not configured well for optimum displacement. Since the scroll set 32 is a symmetric scroll form, that is both pocket sets are geometrically the same, the generating radius offset characteristic is a mirror image of the first pocket shown in FIG. 9. Unlike the hybrid wrap 20 or the first pocket 36 of the offset involute scroll set 32, the generating radius is higher at the beginning of the wrap and lower near the inner portion of the wrap. This can be considered representative of the fact that offset scroll sets are limited in their displacement potential relative to hybrid wrap scroll sets. Also, the pocket surfaces of the offset scroll set do not directly define or approximate the outside diameter of the enclosing envelope.

It should be noted that the integrated values of the generating radius for the two offset pockets 36 and 52 end at the same value. As a rule, for symmetric wraps, the average or integrated value of the generating radius over the outer wrap will be about the same whether or not special wraps or geometries are used. This integrated value represents the change in the swing radius vector which is directed normal to the wrap surface. In other words, after one wrap or revolution, the involute must have been pulled in or out enough that it can begin the next wrap without interfering with itself. Any variation in this rule only represents variation in the thickness of the scroll wall at the point the scroll begins the next wrap. A characteristic value for the generating radius may be defined as $$R_{gc} = \frac{R_{or} + t}{\pi}$$

where $R_{gc}$ equals the characteristic value of the generating radius, $R_{or}$ is the fixed orbiting radius of the scroll element, t is the thickness of the scroll wall at the point where the scroll begins the next wrap, and $\pi$ is the constant 3.14159 . . . . This value $R_{gc}$ for the reference generating radius multiplied by $2\pi$ is the characteristic pitch Pc and is the value of the integrated generating radius over the outer wrap for any combination of simple, complex, or hybrid curves.

The integral of the variable for the entire 360 degrees of the outer wrap is approximately equal to the product of the characteristic generating radius times $2\pi$ as given by the relation:

$$\int_{\theta_{end}-2\pi}^{\theta_{end}} R_g \, d\theta \approx 2\pi R_{gc}$$

wherein $\theta_{end}$ equals the ending wrap angle in radians for the outward point of the outer facing wrap surface.

Figure 11:
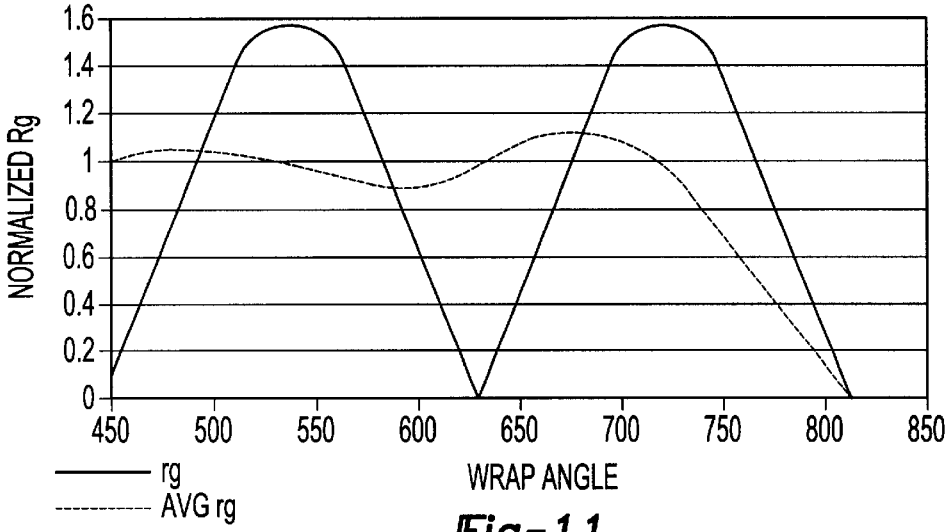
Fig-11 PRIOR ART
FIG. 11 is a graph of the generating radius for a scroll formed of circular arcs.

FIG. 11 illustrates the generating radius for a circular arc scroll set. A circular arc scroll set is known, but not commonly used and is made up of arcs of circles of varying radii spliced together. This may be characterized as the involute of a regular polygon, with one extreme being a circle with effectively an infinite number of sides as illustrated in FIG. 2. The simplest involute of a regular polygon would be the involute of a line segment, a two sided polygon, with the circular arcs extending for 180 degrees each. The generating radius for this case is illustrated in FIG. 11. Although the generating radius begins at zero value, it increases to a maximum and then decreases back to zero in only half a wrap. This pattern repeats throughout the scroll set and there is nothing to distinguish the generating radius in the first portion of the suction pocket from the generating radius in the second portion. There is also little or no benefit in increased displacement over a conventional involute of a circle.

It should be noted that the value of the average generating radius changes rapidly at first, then begins to approach a steady state value equivalent to the involute of a circle. The involute of a regular polygon and of a circle belong to the same class of constant pitch involutes. Over the course of a few wraps, the average generating radius value will approach some constant value representative of the pitch of the spiral. The angular extent of the circular arcs and the speed at which the average generating radius approaches the characteristic value are inversely related to the number of sides as shown in the following table.

Constant Pitch Scroll Forms

| Generating Form | Number of Sides | Angle of Arc Segment |
|---|---|---|
| Line | 2 | 180° |
| Triangle | 3 | 120° |
| Square | 4 | 90° |
| Pentagon | 5 | 72° |
| Hexagon | 6 | 60° |
| . . . | . . . | . . . |
| N-sides | n | 360°/n |
| . . . | . . . | . . . |
| Circle | Infinite | 0 |

While the circular arc scroll contains arcs of a circle as in the hybrid wrap scroll, it behaves in the same manner as the involute of a circle scroll and offers no advantage.

The principal characteristics of the maximum displacement class of scroll wraps can be summarized as having both inlet pockets sharing the characteristics of a low (ideally but not necessarily zero) mean value of generating radius $R_g$ in the outer region, transitioning to a high mean value in the inner region. The outer region and inner region occur within the first 360 degrees of the wrap. Low and high values are considered relative to the characteristic value of the scroll set, which is essentially the value of the generating radius $R_g$ for an involute of a circle which causes each pocket to nest inside the previous one with he same orbit radius and an allowance for a reasonable all thickness in between. The transition to a high value at the inner region of the inner inlet pocket is phased with respect to the outer inlet pocket to cause the inner inlet pocket to nest within the circumference of the outer inlet pocket. A low or nominal value may immediately follow the high value to allow transition to the next portion of the scroll wrap. The only other scroll form which approaches this characteristic is the offset scroll in which the first inlet pocket shares these qualities when referenced to the new scroll center. However, the second inlet pocket, due to its geometric similarity to the first, has exactly the opposite qualities when referenced to the new center. This is an indication of the limitation of the offset scroll in achieving maximum displacement.

The circular arc scroll may start out with a zero value of generating radius $R_g$, but its characteristic repeats every 180 degrees or less of wrap rotation and the mean value of generating radius over the outer portion of the inlet pocket is the same as for the inner portion.

Desirable characteristics of a maximum displacement scroll wrap would include the use of a hybrid of discontinuous curves which is the most direct means of providing a maximum displacement scroll wrap. Sophisticated equations, making use of, for example, exponential step functions, could also accomplish the objective with a continuous curve. To achieve the maximum displacement increase, the scroll wrap will typically have unequal starting angles for the two sets of pockets or working surfaces in order to maintain balanced volumes. Equal starting points may be chosen, but with the compromise of reduced displacement or unbalanced pocket volumes.

The generating radius analysis can be made to focus solely on the outward facing surface of the fixed scroll wrap profile. For a recentered scroll form such as the hybrid wrap or offset circular involute scroll set, the inward facing surface of the fixed scroll wrap profile does not control the overall size of the pump set. The outer end of the inward facing surface of the fixed scroll wrap profile can be extended much further to increase that pocket set's displacement with, however, the resultant disadvantage of unbalanced pocket pairs. It is the outward facing wrap profile of the fixed scroll which controls the overall pump cartridge diameter. The inward facing wrap profile of the fixed scroll is only a consequence of what the outward facing wrap profile of the fixed scroll can achieve in its limited space. However, if the inward facing wrap profile has a similar, though angularly shifted generating radius characteristic as, for example, illustrated in FIG. 6, compared to FIG. 5, then its volume and thus that of the scroll is maximized.

In looking at the outward facing wrap profile for the hybrid wrap fixed scroll of U.S. Pat. No. 5,318,424, the plot of generating radius versus wrap angle for the outer 360 degrees as illustrated in FIG. 5 shows that the value of the generating radius is kept low for as long as possible, followed by a transition region characterized by a large value of generating radius, and finally to a nominal inner value of generating radius. The plot of generating radius versus wrap angle for the outward facing wrap profile in the case of the offset wrap as illustrated in FIG. 9 shows the same general shape for the outside pocket. It does not, of course, have the generating radius spike or other specific features as seen in the hybrid wrap. For its outside 180 degrees, it has a generally low value of generating radius, followed by a generally higher value further in for the second half of the outer 360 degrees. The area of relatively low generating radius for the offset wrap occurs only over the outer 180 degrees, one of the limits to its benefits. The hybrid wrap, in contrast, maintains its relatively low value of generating radius for a much longer region of the outside of the outer 360 degrees of the outward facing wrap profile, thereby achieving a greater benefit.

The generating radius of the wrap's profile should dwell at a relatively low level for greater than 180 degrees. By doing so, this excludes the offset wrap.

Following are several examples of combination of curves that can be used.

EXAMPLE 1: Combination Of Curves

The outer segment can be made an involute of a circle with a very shallow pitch (low value of generating radius). For example, it could have a pitch of perhaps 10 or 20 percent that of the average pitch of the entire profile. This would continue for half a wrap or more before blending into, for example, an arc of a circle or an offset involute with a fairly small radius of curvature which increases the local pitch (increases the generating radius). This would continue for the remainder of the first wrap. At 360 degrees from the outer start, the profile would be displaced inward by the characteristic pitch and would blend into whatever form of curve that is used for the remainder of the wrap.

In general, the principle of Example 1 is to use two or more segments. Candidate curves for the outer portion of the outer wrap include:

1. arc of circle as disclosed in U.S. Pat. No. 5,318,424
2. shallow involute
3. higher order curve with gradually increasing generating radius
4. a parabolic (or similar) variation in generating radius.

Candidate curves for the transition portion, between the outer and inner portions of the wrap include:

1. third (or higher) order involute, an example of which is disclosed in U.S. Pat. No. 5,318,424
2. offset circle
3. offset involute
4. quadratic (second order) involute
5. combination of curves, such as a series of arcs of varying radii.

FIG. 13 shows the first type of outer portion as mentioned above of the five potential outer portion wraps, along with the second type of transition portion, again taken from the five potential transition portions mentioned above.

FIG. 14 shows the first type of outer portion with the third type of transition portion, again with both of the "types" defined from the list of options above.

FIG. 15 shows the first type of outer portion with the fourth type transition portion.

The general object of this application is to provide an outer pocket volume which is larger than that obtained from a conventional scroll wrap which had typically been formed of an involute of a circle. Further, other previously disclosed scroll wraps have used a line or polygon involute composed of segments of circular arcs, or an offset involute of a circle. All of these prior wraps have a common characteristic of a constant pitch and wall thickness.

As is well known in this art, the wrap of a scroll compressor is defined by a pair of terms entitled "swing radius" and "generating radius". These are both essentially vectors emanating from an origin of a coordinate system. The vectors define definite points or segments on a scroll curve. To construct the swing and generating radius for any given point on a scroll wrap, a line may be projected through the point which is normal or perpendicular to the scroll surface at that point. A second line which passes through the origin of the coordinate system and which is normal or perpendicular to the first line is also drawn. The generating radius is the line segment along the second line that extends between the origin and the first line. As an example, segment 46 in FIG. 8 illustrates an example where the coordinate origin is at the center of the circle. The swing radius is the line segment extending along the first line from the scroll surface to the intersection with the generating radius. Segment 48 in FIG. 8 is an example of the swing radius.

The displacement volume contribution of any given scroll segment is roughly proportional to the magnitude of its swing radius relative to the rest of the scroll form. The rate at which the swing radius changes as it transverses along the scroll wrap is proportional to the magnitude of the generating radius. These propositions are known within the scroll compressor art, and can be demonstrated mathematically.

To maximize the displacement volume of an outer pocket, it would be desirable to maximize the average swing radius over the entire pocket (360° of wrap length at the outer end of the wrap). The small value for the generating radius will result in the swing radius being reduced only a little as it transverses inward from the outer end of the wrap. This will thus maximize displacement volume. However, at the end of the first 360°, the swing radius must have been reduced enough that the scroll wrap has moved in a sufficient distance to provide operating room for the mating wrap. This will include the wall thickness and the orbit diameter. In a conventional involute of a circle scroll wrap, the larger constant generating radius allows a cumulative reduction in swing radius to accommodate this requirement. However, in the inventive modified wrap with a small generating radius, as one nears the end of the first 360°, it can be seen that the swing radius may not have reduced sufficiently to provide running room for the mating wrap. This is addressed by reducing the swing radius at a very rapid rate at the very inner end of the first wrap. Because of the relationship between swing and generating radii, this means the generating radius must increase to a very high value in the zone to achieve rapid reduction in swing radius. Thus, the various examples shown in FIGS. 13–16 illustrate various specific designs which take advantage of the principle of this invention. The examples of FIGS. 5 and 6 show a prior art design which is a specific case of this general principle and which is excluded from the claims. FIGS. 5 and 10 illustrate a prior art design where only one set of pockets take advantage of this principle but the other set, as shown in FIG. 10, do not. The present invention specifically applies this design concept to both pockets. While the graphs of FIGS. 13–16 do not show actual scroll wraps, in fact, a worker of ordinary skill in this art would recognize that much more information is conveyed from the graphs than from a drawing of the wraps. A worker in this art would be able to determine the types of changes which incorporate this invention by reviewing these graphs. A scroll designer learns more from a graph of these radii, than perhaps would be learned from even a drawing of the resulting wraps Thus, the present invention does not address any particular scroll wrap, but rather a family of wraps as are defined by the FIGS. 13–16.

Options 2, 3 and 4 immediately above are restricted in their flexibility compared with the preferred option 1 and may require some adjustment of compromise in either the outer or inner curves to accommodate them. Option 5 overcomes this difficulty by splicing together a series of lower order curves to achieve the flexibility of a single higher order curve. Option 5 is effectively an involute of an irregular polygon, which becomes a general case of the more restricted and inflexible case of the circular arc scroll, which was defined as the involute of a regular polgon.

EXAMPLE 2: Single Higher Order Curve

A single higher order curve could be formulated which could replace, for example, the combination of an arc of a circle and a higher order curve segment as disclosed in U.S. Pat. No. 5,318,424. A curve of between fifth and seventh order would have enough flexibility to both approximate the outer circular wrap portion and the high order transition to the inner wraps. To formulate such a curve, a series of boundary conditions need to be specified. The higher order curve then needs simply to have enough degrees of freedom to satisfy those conditions, as shown in FIG. 16.

If the basic requirements are the specification of generating and swing radii at three points (the outer terminus, the transition to the inner wraps, and a point in between), then the resulting six boundary conditions can be satisfied by a fifth order polynomial. It may be found that requirements have to be added on the slope of the generating radius at one or both of the outer two points to better approximate a circular arc segment. This would require a sixth or seventh order polynomial.

All of the described options will share the quality of having a generally low average value of generating radius in the outermost portion of the outer wrap and a generally high value of generating radius in the inner portion of the outermost wrap. By going to a greater number of simpler curves or to a single much more complex curve, benefits such as realized by the device disclosed in U.S. Pat. No. 5,318,424 can be duplicated to a large extent. A fewer number of simpler curves can also be made to work, but with somewhat less effective results or with some compromise on, or increasing complexity of, the geometry of the interior wraps. However, even the fewer number of simpler curves can be easily made to surpass the benefit of the offset wraps of FIG. 7.

Although preferred embodiments of the present invention have been illustrated and described, other modifications will occur to those skilled in the art. It is therefore intended that the present application is to be limited only by the scope of the appended claims.

What is claimed is:

1. A scroll element for a scroll machine wherein said scroll element has a wrap surface extending from an outer point to an inner point, the wrap surface being defined, in part, by a generating radius, the wrap surfacing having a lower generating radius for at least an outer portion of the wrap surface extending more than 180 degrees from the outer point and a higher generating radius for at least an inner portion of the wrap surface, said higher generating radius being higher than said lower generating radius the generating radius having no constant value of zero extending 360 degrees from the outer point.

2. The scroll element of claim 1 wherein the wrap surface is the outward facing surface of the fixed scroll wrap.

3. The scroll element of claim 1 wherein the scroll machine has dual pockets, the wrap surface having a low generating radius for at least the outer portion of the wrap surface and a high generating radius for at least the inner portion of the wrap surface for only a first one of said pockets.

4. The scroll element of claim 1 wherein the scroll machine has dual pockets, the wrap surface having a low generating radius for at least the outer portion of the wrap surface and a high generating radius for at least the inner portion of the wrap surface for both pockets.

5. The scroll element of claim 1, wherein the description of said generating radii in claim 1 is with regard to absolute values.

6. The scroll element of claim 1, wherein the description of said generating radii is taken by the mean of a generating radii of the wrap integrated from an outer point on a wrap surface.

7. A scroll element for a scroll machine, wherein said scroll element has an outward facing wrap surface and an inward facing wrap surface, the outward facing wrap surface extending from an outward point to an inner point, the outward facing wrap surface having an outer wrap extending from the outward point inwardly, and which has a characteristic generating radius $R_{gc}$ given by the relation $$R_{gc} \approx \frac{R_{or} + t}{\pi}$$

where $R_{gc}$ is the characteristic generating radius, $R_{or}$ is the fixed orbiting radius of the scroll element, t is the thickness of the wall between the outward facing and the inward facing surfaces at the inner end of the outer 360 degrees of the scroll element, and $\pi$ is the constant 3.14159 . . . ;

the outward facing wrap surface further defined in part by a generating radius whose value varies over the extent of the outer wrap, the variable generating radius having the properties of:

(a) having an average value lower than the characteristic generating radius for greater than the outermost 180 degrees of the wrap surface; and (b) having an average value higher than the characteristic generating radius for the inner remainder of the outer wrap surface for less than 180 degrees but wherein the outward facing wrap surface does not use in sequence, from the outward point to the inner point, a circle, a high order curve and an involute.

8. The scroll element of claim 1 wherein the integral of the variable generating radius for the entire 360 degrees of the outer wrap is approximately equal to the product of the characteristic generating radius times $2\pi$ as given by the relation $$\int_{\theta_{end}-2\pi}^{\theta_{end}} R_g \, d\theta \approx 2\pi R_{gc}$$

where $\theta_{end}$ equals the ending wrap angle in radians for the outward point of the outward facing wrap surface.

9. The scroll element of claim 1 wherein the scroll element is a fixed scroll.

10. The scroll element of claim 1 wherein the scroll machine has dual pockets and the specific properties of the generating radius applies to a first one of said pockets.

11. The scroll machine of claim 4 wherein the second one of said pockets has a variable generating radius which has characteristics similar to the first one of said pockets.

* * * * *